US010260385B2

(12) United States Patent
Boscolo et al.

(10) Patent No.: US 10,260,385 B2
(45) Date of Patent: Apr. 16, 2019

(54) GASKET FOR A VALVE OF AN INTERNAL COMBUSTION ENGINE

(71) Applicant: FREUDENBERG SEALING TECHNOLOGIES S.A.S. DI EXTERNA ITALIA S.R.L.U., Pinerolo (IT)

(72) Inventors: Marco Boscolo, Pinerolo (IT); Armin Barth, Pinerolo (IT)

(73) Assignee: FREUDENBERG SEALING TECHNOLOGIES S.A.S. DI EXTERNA ITALIA S.R.L.U. (IT)

( * ) Notice: Subject to any disclaimer, the term of this patent is extended or adjusted under 35 U.S.C. 154(b) by 0 days.

(21) Appl. No.: 15/455,367

(22) Filed: Mar. 10, 2017

(65) Prior Publication Data

US 2018/0112564 A1 Apr. 26, 2018

(30) Foreign Application Priority Data

Oct. 21, 2016 (IT) ..... 102016000106389

(51) Int. Cl.
*F01L 3/08* (2006.01)

(52) U.S. Cl.
CPC ..... *F01L 3/08* (2013.01); *F01L 2101/00* (2013.01)

(58) Field of Classification Search
CPC . F01L 2101/00; F01L 3/08; F01L 3/02; F16K 5/20
See application file for complete search history.

(56) References Cited

U.S. PATENT DOCUMENTS

| | | | | |
|---|---|---|---|---|
| 3,480,286 | A * | 11/1969 | Kosatka | F01L 3/08 123/188.6 |
| 5,558,056 | A | 9/1996 | Sakata | |
| 6,056,270 | A * | 5/2000 | Zimmerly | F16K 1/38 137/15.18 |
| 6,571,761 | B1 * | 6/2003 | Leimer | F01L 3/08 123/188.6 |
| 7,438,036 | B2 * | 10/2008 | Hesher | F01L 3/08 123/188.6 |
| 9,052,018 | B2 * | 6/2015 | Hegemier | F01L 3/08 |

(Continued)

FOREIGN PATENT DOCUMENTS

| | | |
|---|---|---|
| FR | 2728017 | 6/1996 |
| WO | 2013009479 | 1/2013 |

OTHER PUBLICATIONS

Corresponding Italian Search Report and Written Opinion for IT201600106389 dated May 19, 2017.

*Primary Examiner* — Long T Tran
(74) *Attorney, Agent, or Firm* — The Belles Group, P.C.

(57) ABSTRACT

There is described a gasket for a valve of an internal combustion engine; this gasket has a central axis and comprises: an elastically deformable annular seal element; a support member made of plastic material, also annular and having at least a retention portion coupled coaxially on a first portion of the seal element to press it on a guide element of the valve; and elastic means acting on a second portion of the seal element to press it on a stem of the valve; the elastic means comprise a thrust portion of the support member made in one single piece with the retention portion; the seal element is formed by means of an injection molding operation in a molding chamber containing the support member.

14 Claims, 12 Drawing Sheets

(56) References Cited

U.S. PATENT DOCUMENTS

| | | | | |
|---|---|---|---|---|
| 2005/0001196 | A1* | 1/2005 | Mc Arthy | F01L 3/08 251/214 |
| 2008/0203346 | A1* | 8/2008 | Shu | F16K 3/243 251/214 |
| 2013/0015625 | A1* | 1/2013 | Hegemier | F01L 3/08 277/502 |
| 2013/0192555 | A1* | 8/2013 | Nguyen | F01L 3/08 123/188.6 |
| 2014/0130766 | A1* | 5/2014 | Sakata | F01L 3/08 123/188.6 |

* cited by examiner

GASKET FOR A VALVE OF AN INTERNAL COMBUSTION ENGINE

PRIORITY CLAIM

This application claims priority from Italian Patent Application No. 102016000106389 filed on Oct. 21, 2016, the disclosure of which is incorporated by reference.

TECHNICAL FIELD

The present invention relates to a gasket for a valve of an internal combustion engine.

BACKGROUND OF THE INVENTION

Internal combustion engines for vehicles are known, comprising a head with one or more cylinders, inside which the engine cycle takes place, and which are connected with respective combustion chambers of the engine. Moreover, suitable seats are obtained on the aforesaid head, intended to connect the combustion chamber with ports adapted to supply said chamber with a mixture of unburnt fuel and air ("intake ports"), and to remove the burnt gases from said combustion chamber ("exhaust ports").

The flows from and towards each combustion chamber are controlled by suitable valves acting on the aforesaid seats. In particular, each valve essentially comprises a guide element, secured inside a cavity of the cylinder head of the motor and defining a through seat, and a stem, sliding in opposite directions inside the aforesaid seat and carrying at one end a closing portion for closing the connection between the relative intake or exhaust port and the corresponding combustion chamber.

The opposite end of the stem of the valve projects axially from the relative guide element and is adapted to receive operating forces from a relative control device, for example a cam shaft.

The stem of the valve is axially loaded by a cylindrical helical spring in the direction for closing the connection between the relative intake or exhaust port and the corresponding combustion chamber.

In particular, the spring is mounted coaxially around the valve and is axially interposed between a fixed surface obtained on the cylinder head and a plate secured to the stem of the valve close to or at the end of the stem cooperating with the control device.

Sealing gaskets are normally fitted on valves of the type described above for the lubricating oil normally circulating in engines. These gaskets, in one of the most commonly known forms, comprise a support or reinforcing member, having a substantially tubular or annular shape and made in one single piece of metal material, and an annular seal element, made of an elastomeric material and interposed between the support member and the valve.

In particular, the seal element typically comprises a first portion adapted to cooperate, by means of a radially internal annular surface thereof, with the radially external annular surface of the portion of the guide element in use facing the aforesaid control device, and a second portion adapted to cooperate directly with the valve stem.

Gaskets of the type described above are widely used on all internal combustion engines to control the amount of lubricating oil that flows from the distribution area towards the combustion chambers. An excessive flow of lubricating oil, besides causing an evident excessive consumption of this oil, also causes a deterioration of engine efficiency and a reduction in the performance of the vehicle catalyst. On the other hand, insufficient flow causes an increase in wear and noise of the valves accompanied by the presence of local temperature spikes. These phenomena can cause premature damage to the valves resulting from seizure of the valve stem inside the guide element.

Known gaskets allow, by means of the first portion of the seal element acting on the guide element of the relative valve, the achievement of a static seal, and, by means of the second portion of the seal element cooperating with the stem, the achievement of a dynamic seal. In particular, the static seal must ensure a certain degree of radial compression on the guide element in order to prevent leakage of lubricating oil towards the combustion chambers and at the same time maintain the gasket in position, while the dynamic seal is designed to allow the minimum flow of oil necessary for lubrication of the coupling between stem and guide element.

In particular, the support member comprises a roughly cylindrical retention portion, coupled coaxially on the first portion of the seal element so that this first portion is radially interposed in use between the retention portion and the guide element of the valve.

In order to generate the radial pressure necessary to define the dynamic seal, an elastic ring is commonly mounted on the second portion of the seal element, intended to act directly on the valve stem; this ring has the function of tightening the second portion of the seal element on the stem with a pressure such as to allow minimum leakage of oil to lubricate the guide element—stem coupling.

Although the solution described is functionally valid, it is susceptible to further improvements: in fact, there is the need to reduce the number of components to be managed and fitted to achieve the gaskets of the aforesaid type, in order to also simultaneously reduce the costs of these latter.

Moreover, over time the elastic ring could lose part of its elasticity, thereby compromising the correct operation of the gasket; in fact, it has been noted that this loss of elasticity generally occurs in a shorter time with respect to the normal life cycle of the other components of the gasket.

It must also be mentioned that the elastic ring could become unseated during shipping or assembly on the engine valve.

In order to reduce the total number of components forming the gaskets of known type and to overcome the problem specified above, the U.S. Pat. No. 6,516,769 proposes replacing the elastic ring with a thrust portion of the support member, made in one single piece with the retention portion.

However, this solution does not seem completely satisfactory from the point of view of the coupling to be achieved between the seal element and the support member while fitting the gasket.

Moreover, the need to couple two components with complex shapes tends to set limitations during the design thereof, which could penalize, even only partially, their respective functionality or at least the overall radial dimensions of the gasket.

SUMMARY OF THE INVENTION

The object of the present invention is therefore to produce a gasket for a valve of an internal combustion engine, which allows the aforesaid problems related to gaskets of known type to be solved in a simple and inexpensive manner.

The aforesaid object is achieved by the present invention, as it relates to a gasket for a valve of an internal combustion engine as defined in claim 1.

BRIEF DESCRIPTION OF THE DRAWINGS

For a better understanding of the present invention, some preferred embodiments are described below purely by way of non-limiting examples and with reference to the accompanying drawings, wherein.

DETAILED DESCRIPTION OF THE INVENTION

Figure 1:
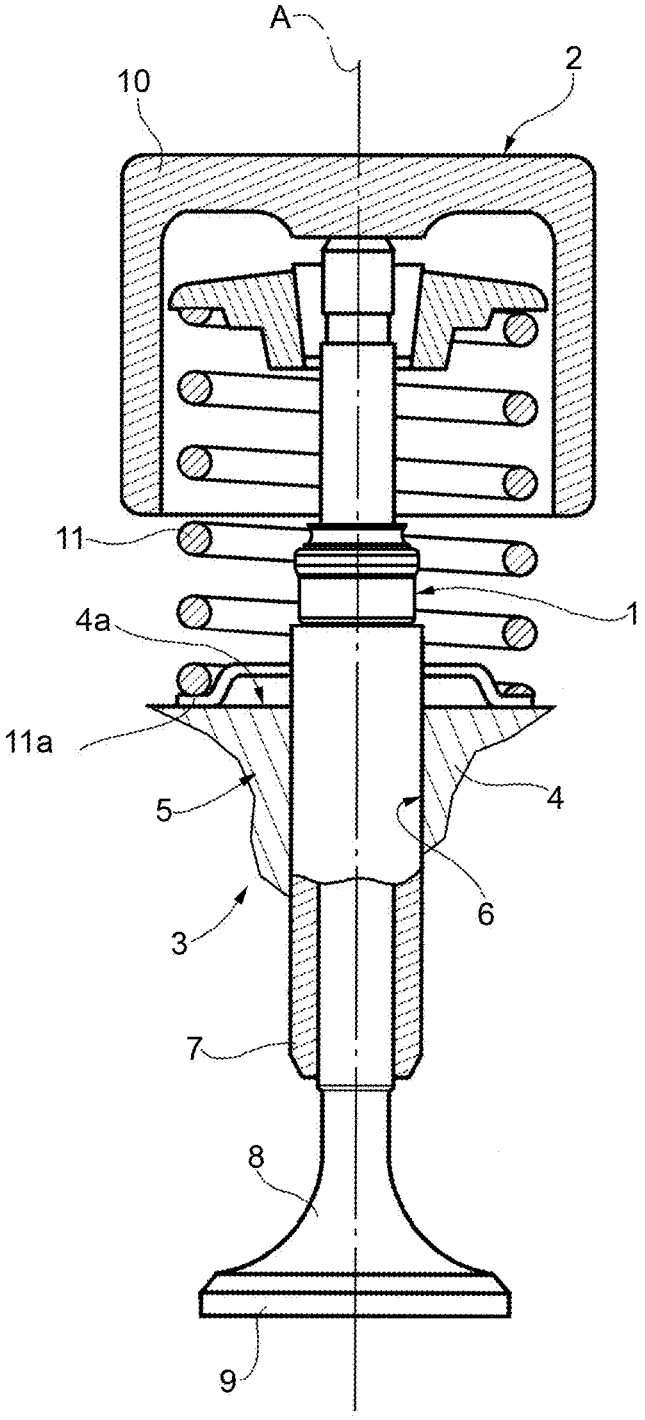
FIG. 1 illustrates, in a side elevation and partially sectional view, a portion of an internal combustion engine provided with a gasket according to the present invention for a valve of the engine.
Figure 2:
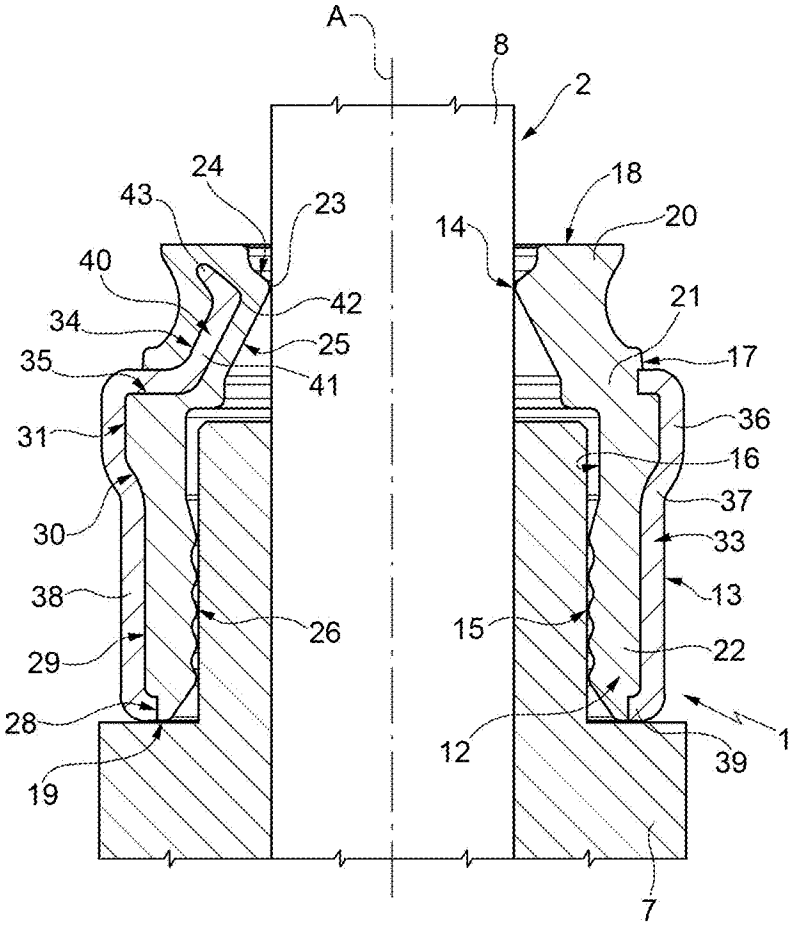
FIG. 2 illustrates, in an axial section and on an enlarged scale, the gasket of FIG. 1 and the part of the valve on which this gasket is fitted.

With reference to FIGS. 1 to 4, the reference numeral 1 indicates as a whole a gasket according to the present invention for a valve 2 of an internal combustion engine 3, per se known and illustrated in FIGS. 1 and 2 only to the extent necessary to understand the present invention.

In greater detail, in FIGS. 1 and 2, the engine 3 is illustrated limited to a portion 4 of a head 5, which defines in a known manner a combustion chamber (not visible in FIGS. 1 and 2, but arranged below the portion 4 of the head 5 illustrated), inside which a fuel is oxidized in the presence of combustion air so as to transform the chemical energy contained in the fuel into pressure energy.

The combustion chamber receives in a known manner, through an opening thereof, a mixture comprising the fuel and the combustion air and discharges, through another opening, the burnt gas and air at the end of the combustion process.

The flows towards and from the combustion chamber are controlled by respective valves 2 of the type mentioned above, acting on said openings of the combustion chamber.

The following description will refer for simplicity to a single valve 2, it being understood that the same features described are present in each valve of this type used in the engine 3.

With reference to FIGS. 1 and 2, the valve 2 is housed in a through seat 6, which is formed in the portion 4 of the head 5 and normally contains lubricating oil.

The valve 2 has an axis A and comprises a tubular guide element 7 fitted by interference inside seat 6, and a mobile stem 8 sliding in opposite directions along the axis A within the guide element 7.

In greater detail, the stem 8 projects from opposite sides of the guide element 7 and is provided, at the opposite axial ends thereof, respectively, with a closing element 9, intended to sealingly engage the relative opening in the combustion chamber, and an actuating element or plate 10 adapted to receive driving forces from a control mechanism, per se known and not illustrated, such as a camshaft.

The axial end portion of the guide element 7, from which the end of the stem 8 provided with the plate 10 projects, is fitted externally with a relative gasket 1 according to the invention, coaxially surrounding both the guide element 7 and the stem 8.

Moreover, the valve 2 comprises a spring 11, in the example illustrated of helical type, which cooperates, at the mutually opposite axial ends thereof, with the plate 10 and with a ring 11*a* pressed axially by the spring 11 against a fixed annular surface 4*a* with axis A facing the plate 10 and delimiting the portion 4 of the head 5.

The spring 11 is adapted to generate an elastic return force on the stem 8 such as to maintain it in contact at all times, at the plate 10, with the control mechanism.

Figure 3:
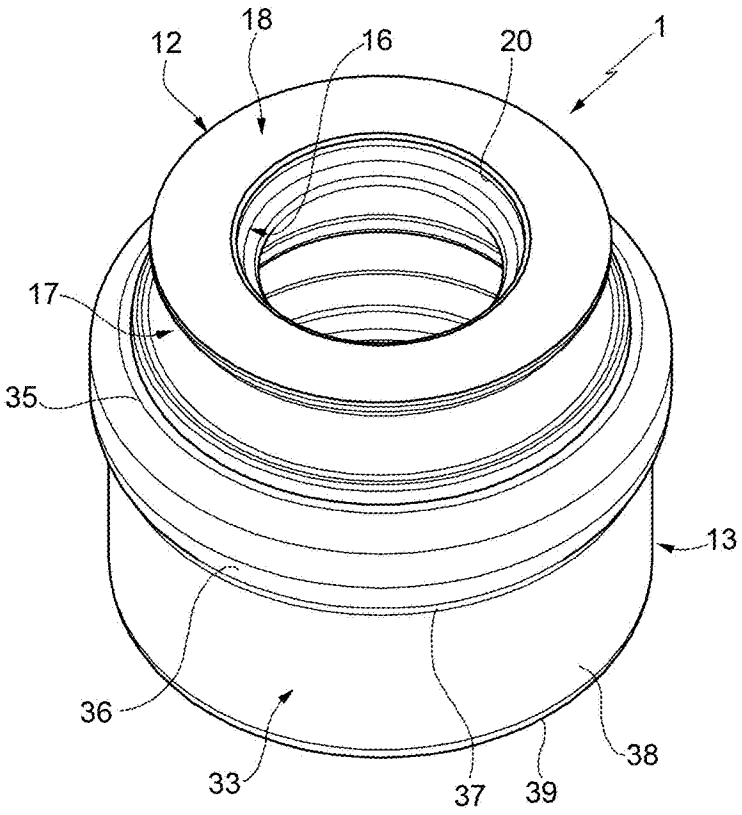
FIG. 3 illustrates the gasket of FIG. 1 in a perspective view.
Figure 4:
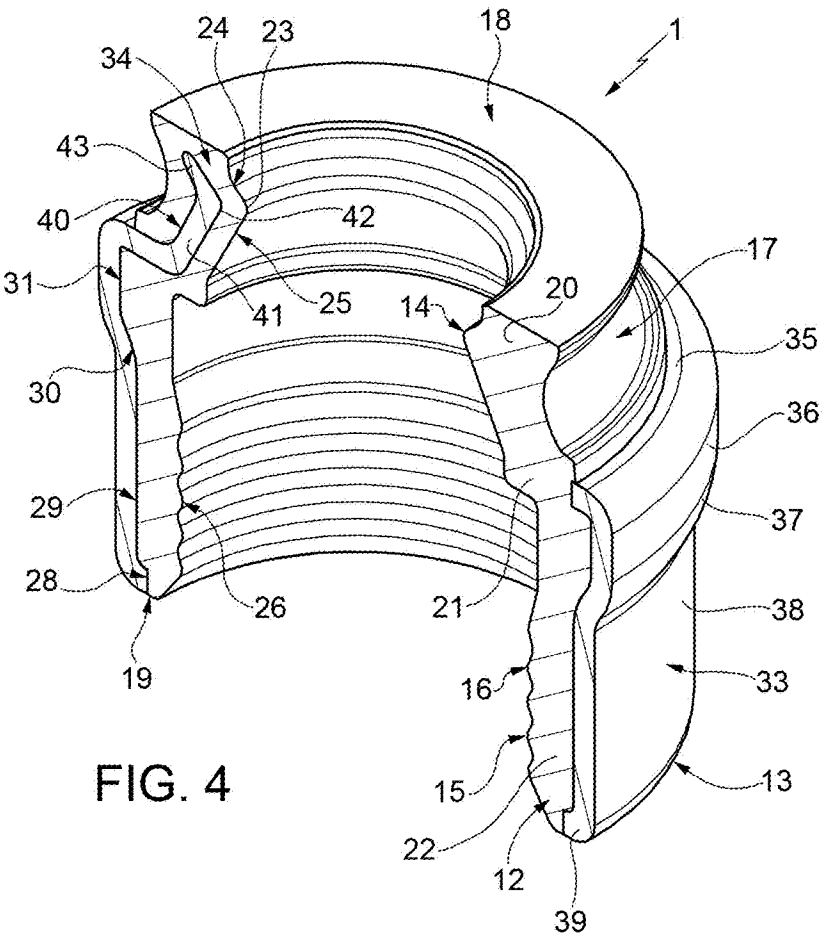
FIG. 4 illustrates the gasket of FIG. 1 in a partially sectional perspective view.

With particular reference to FIGS. 2 to 4, the gasket 1 has an annular shape with respect to an axis coinciding, in assembly conditions, with the axis A.

More precisely, the gasket 1 comprises:

- an elastically deformable seal element 12, having an annular shape with respect to the axis A and adapted to be arranged externally on the valve 2; and
- a support member 13 having an annular shape with respect to axis A and cooperating coaxially with the seal element 12 to press this latter, in a radial direction with respect to the axis A, on the guide element 7 and on the stem 8 of the valve 2.

In practice, the seal element 12 is mostly interposed coaxially between the support member 13 and the valve 2.

Preferably, the seal element 12 comprises a fluorinated elastomer.

The seal element 12 defines, proceeding along the axis A towards the closing element 9 of the stem 8, firstly a dynamic seal 14 adapted to allow the passage of a minimum flow of oil necessary for lubrication of the coupling between the stem 8 and the guide element 7, and subsequently a static seal 15 to prevent the flow of oil towards the combustion chamber.

With reference to FIGS. 2 to 4, the seal element 12 is delimited by a pair of annular side surfaces 16, 17 opposite each other.

More precisely, the side surface 16 delimits the seal element 12 in a radially internal position with respect to the axis A and on the side of the axis A. The side surface 17 delimits the seal element 12 in a radially external position with respect to the axis A and on the opposite side of the axis A.

Moreover, the seal element 12 is delimited axially by a head surface 18 facing the opposite side of the closing element 9, and therefore the plate 10, and by a head surface 19, opposite the surface 18, facing the side of the closing element 9.

The side surfaces 16, 17 each extend between the head surface 18 and the head surface 19.

The seal element 12 comprises, proceeding from the head surface 18 towards the head surface 19, (FIGS. 2 and 4):

a portion 20, which originates from the head surface 18;

a portion 21; and a portion 22, which ends in the head surface 19.

In particular, the portion 21 is axially interposed between the portions 20 and 22.

The side surface 16 of the portion 20 cooperates directly with the stem 8 at a section of minimum diameter defined by an annular edge 23; this annular edge 23 is adapted to be pressed radially in use against the stem 8 to define a dynamic circumferential seal line (seal 14), which, as indicated previously, as a result of sliding coupling with the stem 8, allows the leakage of a minimum flow of oil necessary for lubrication of the coupling between the stem 8 and the guide element 7.

Moreover, the side surface 16 of the portion 20 comprises a pair of segments 24, 25 arranged on axially opposite sides of the annular edge 23 and joined to this latter.

The segments 24, 25 are both inclined with respect to the axis A.

The segment 24 is adjacent to the head surface 18, while the segment 25 is adjacent to the portion 21.

In greater detail, the segment 24 converges in the annular edge 23 with a first angle of conicity and the segment 25 diverges from the annular edge 23 with a second angle of conicity, proceeding parallel to the axis A and according to the direction orientated from the head surface 18 towards the head surface 19. In other words, the segment 24 has a diameter decreasing with respect to the axis A towards the annular edge 23, while the segment 25 has a diameter increasing with respect to the axis A starting from the annular edge 23.

Preferably, the second angle of conicity is less than the first angle of conicity.

In the example illustrated, the segment 25 has a larger extension than the segment 24.

The side surface 16 of the portion 22 comprises a plurality of undulations 26 pressed on the guide element 7 so as to define the static seal 15 on the guide element 7.

The side surface 16 of the portion 21 has smaller radial dimensions than the radial dimensions of the side surface 16 of the portion 22 and defines a sort of annular step between the portions 20 and 22.

The side surface 17 of the portion 20 has, in the example illustrated, a concave shape.

The side surface 17 of the portion 20 has smaller radial dimensions with respect to the side surface 17 of the portion 22.

The side surface 17 of the portion 22 has, proceeding from the head surface 18 towards the portion 21, increasing radial dimensions.

In particular, proceeding from the head surface 19 towards the portion 21, the side surface 17 of the portion 22 comprises:

an axial end segment 28;

an axially elongated segment 29 having radial dimensions greater than the segment 28;

a curved segment 30 diverging with respect to the axis A; and an axially elongated segment 31 having radial dimensions larger than the segment 29.

The support member 13 is formed of one single component made entirely of plastic material.

Preferably, the support member 13 can be made of high performance thermoplastic material with excellent mechanical and thermal resistance properties, capable of replacing the functions of the metal materials in static and dynamic applications; the thermoplastic material forming the support member 13 may or may not be reinforced with appropriate agents, for example of organic or inorganic type. In the example illustrated, the support member 13 comprises a polyamide polymer, for example a PA6 or PA66 plastic.

In particular, the support member 13 comprises as a whole:

a retention portion 33 coupled coaxially on the portion 22 of the seal element 12 so that this portion 22 is radially interposed in use between the retention portion 33 and the valve 2;

a thrust portion 34 acting on the portion 20 of the seal element 12 to radially press in use the portion 20 on the valve 2; and a connection portion 35 axially interposed between the retention portion 33 and the thrust portion 34 and connecting these latter to each other to form a single piece.

The retention portion 33 comprises, proceeding in a direction parallel to the axis A from the connection portion 35 towards the head surface 19:

a cylindrical segment 36 originating from the connection portion 35, extending axially and pressed on the segment 31 of the side surface 17 of the portion 22 of the seal element 12;

a curved or truncated-cone shaped segment 37, folded towards the axis A and pressed on the segment 30 of the side surface 17 of the seal element 12;

a cylindrical segment 38 extending axially and pressed on the segment 29 of the side surface 17 of the seal element 12; and a segment 39 radially folded towards the axis A and pressed on the segment 28 of the side surface 17 of the seal element 12.

In this way, the portion 22 of the seal element 12 is contained axially between the segment 39 and the connection portion 35 of the support member 13.

The connection portion 35 of the support member 13 extends radially to the axis A and partially penetrates the seal element 12; in particular, the connection portion 35 cooperates, at an end face thereof facing the head surface 18, with the portion 20 of the seal element 12 and, at an end face thereof facing the head surface 19, with the portion 21 of the seal element 12.

Advantageously, the thrust portion 34 is shaped so as to exert a pressing action of the portion 20 of the seal element 12 directly on the stem 8 of the valve 2 so as to produce the dynamic seal 14 and prevent the use of additional elastic rings typically used in conventional solutions.

Figure 5:
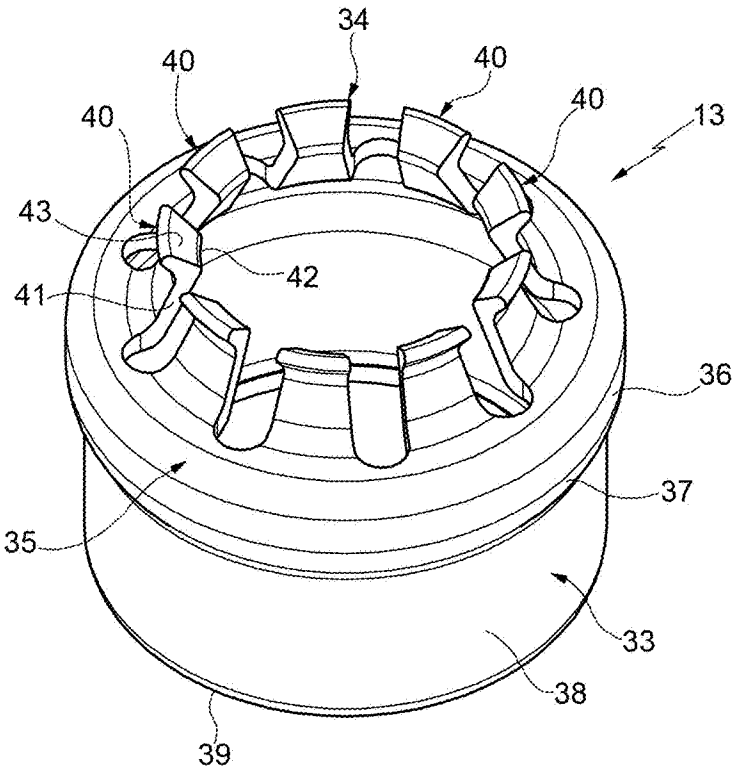
FIG. 5 illustrates, in a perspective view, a support member of the gasket of FIG. 1.

As can be seen in detail in particular in FIG. 5, the thrust portion 34 comprises a plurality of fins 40, incorporated within the portion 20 of the seal element 12, equally spaced angularly from one another around the axis A and projecting in an overhanging manner from the radially innermost edge of the connection portion 35.

In greater detail, each fin 40 projects towards the axis A starting from the connection portion 35 so as to generate a thrust action on the portion 20 of the seal element 12 such as to cause this latter to abut against the stem 8 at the annular edge 23.

Each fin 40 has a profile similar to that of the side surface 16 at the portion 20 of the seal element 12. More precisely, each fin 40 comprises:

- a first pressure portion 41, extending in an overhanging manner from the radially innermost edge of the connection portion 35 and having a distance progressively decreasing with respect to the axis A starting from the connection portion 35 as far as an edge 42 with minimum radial distance from the axis A; and
- a second portion 43 having a distance progressively increasing with respect to the axis A starting from the edge 42 and defining the axial end of the fin 40.

In practice, the portions 41 and 43 are both inclined with respect to the axis A, are arranged on axially opposite parts with respect to the edge 42 and are joined thereto.

The portion 41 converges towards the edge 42 and towards the axis A, while the portion 43 diverges from this edge 42 and from the axis A.

Similarly to the side surface 16 of the portion 20 of the seal element 12 and proceeding parallel to the axis A starting from the connection portion 35, the portions 41 of the fins 40 converge in the respective edges 42 with an angle of conicity substantially identical to that of the segment 24, while the portions 43 diverge from these edges 42 with an angle of conicity substantially identical to that of the segment 25.

In the example illustrated, the portion 41 has a greater extension than the portion 43.

Figure 6:
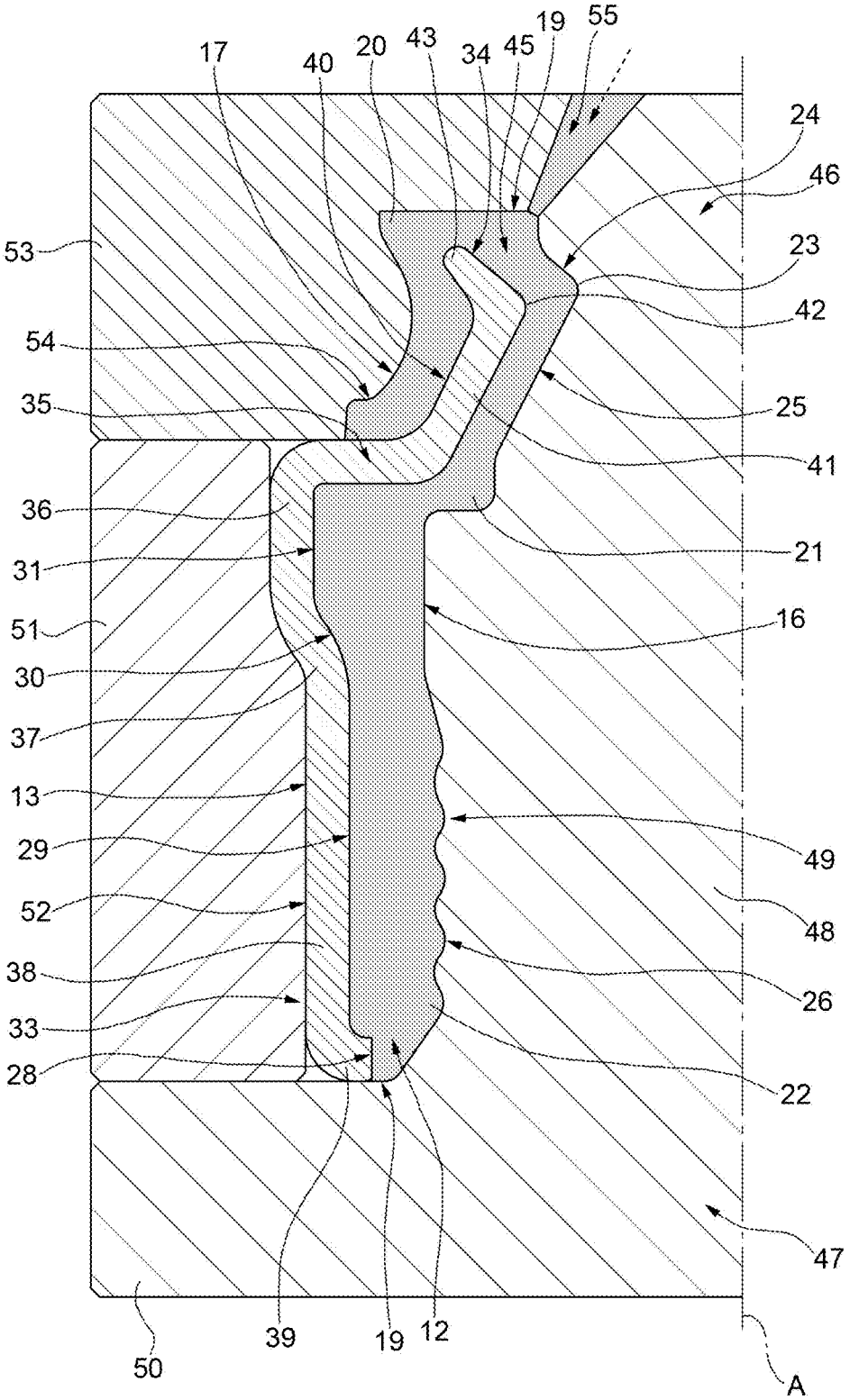
FIG. 6 illustrates, in an axial half-section and on an enlarged scale, the gasket of FIG. 1 during a moulding operation to produce it.
Figure 8:
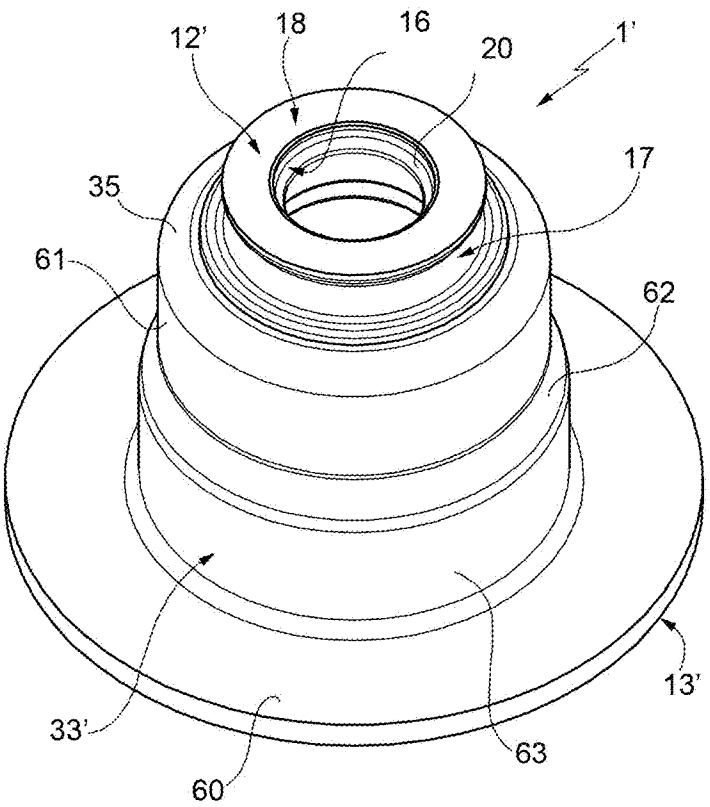
FIG. 8 illustrates the gasket of FIG. 7 in a perspective view.
Figure 7:
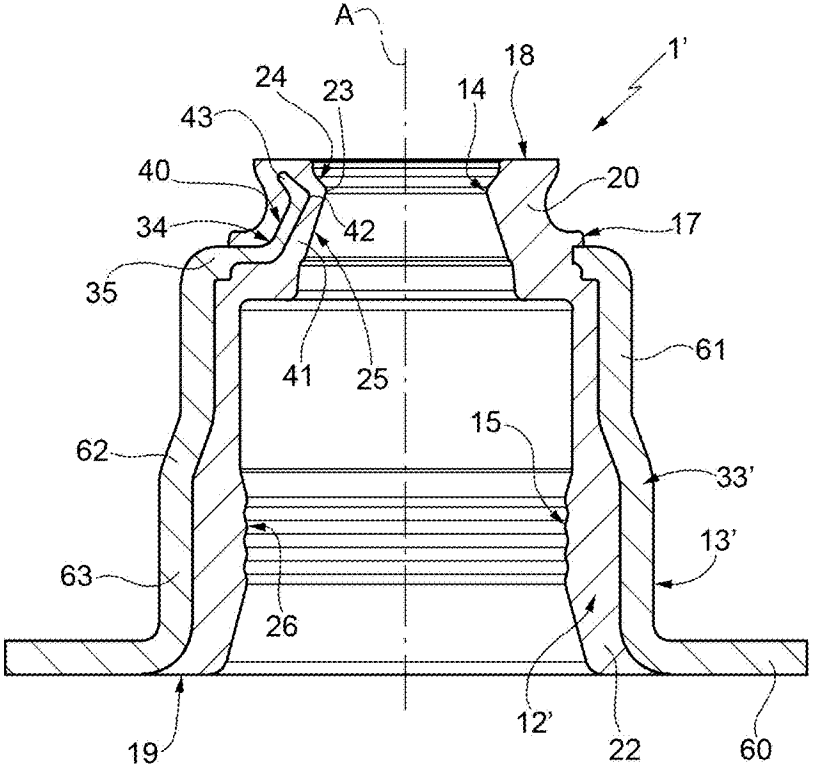
FIG. 7 illustrates, in an axial section, a different example of embodiment of a gasket according to the present invention.
Figure 10:
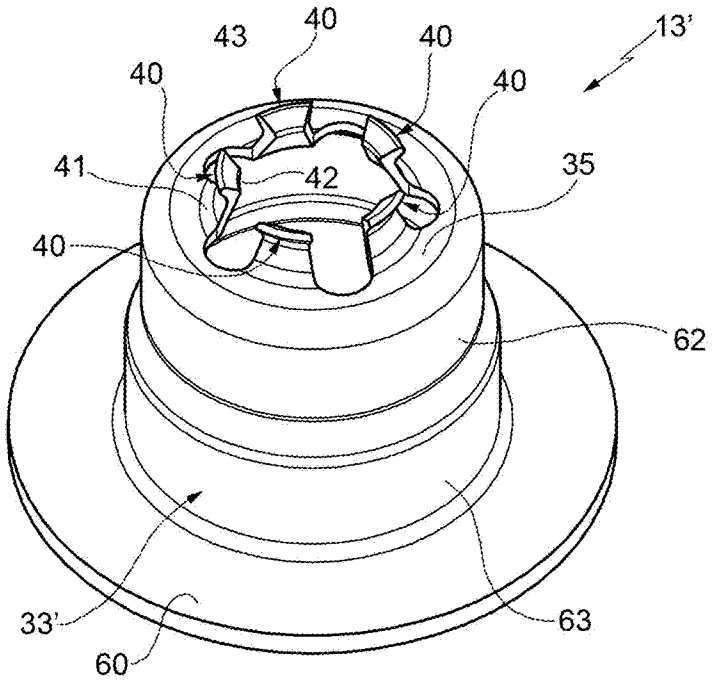
FIG. 10 illustrates, in a perspective view, a support member of the gasket of FIG. 7.
Figure 9:
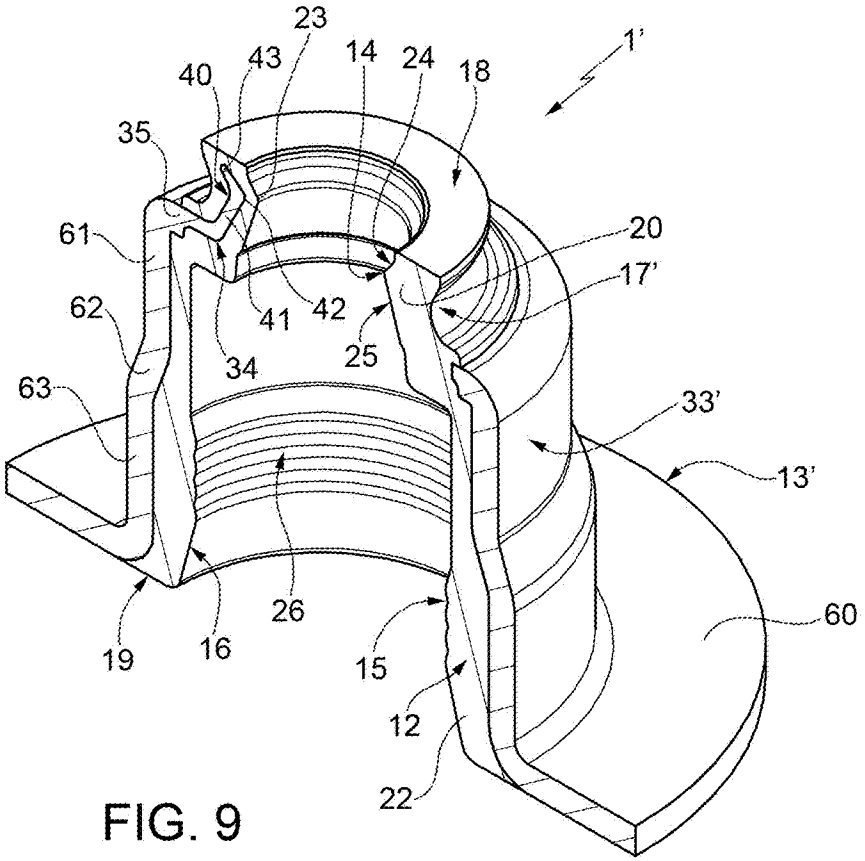
FIG. 9 illustrates the gasket of FIG. 7 in a partially sectional perspective view.
Figure 12:
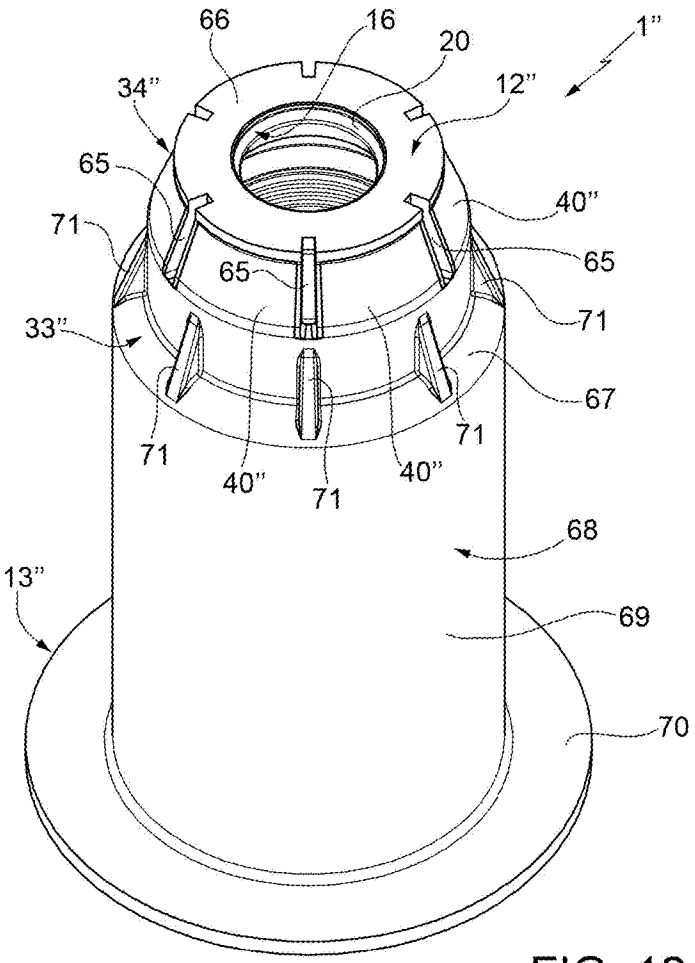
FIG. 12 illustrates the gasket of FIG. 11 in a perspective view.
Figure 11:
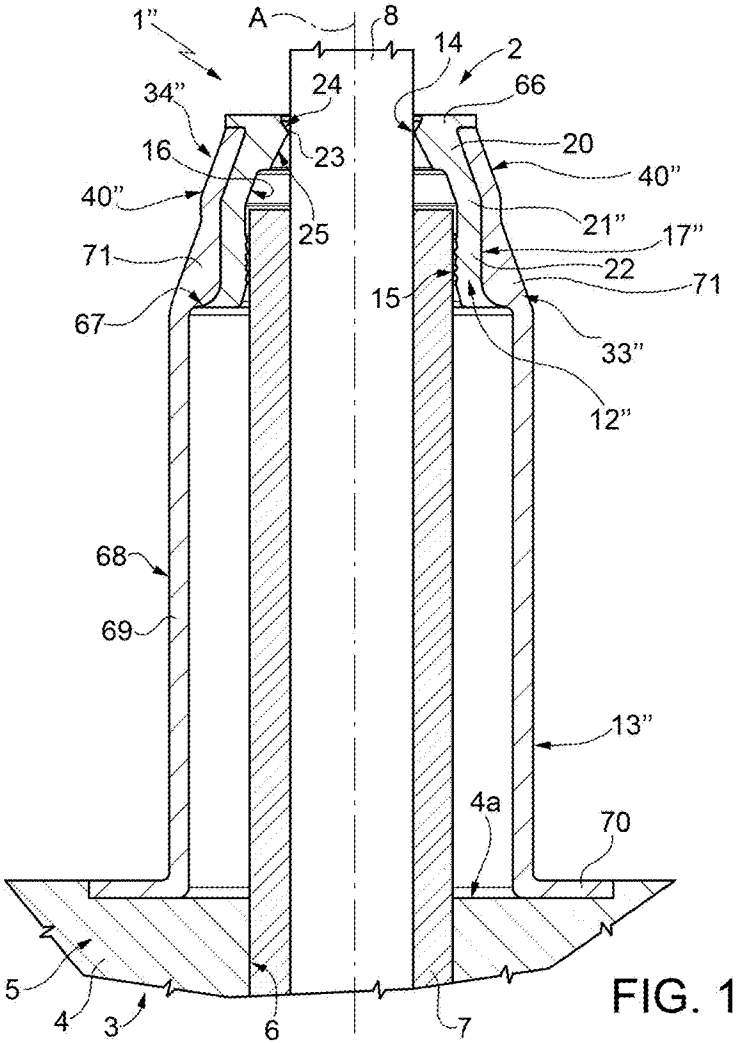
FIG. 11 illustrates in an axial section a further example of embodiment of a gasket according to the present invention.
Figure 14:
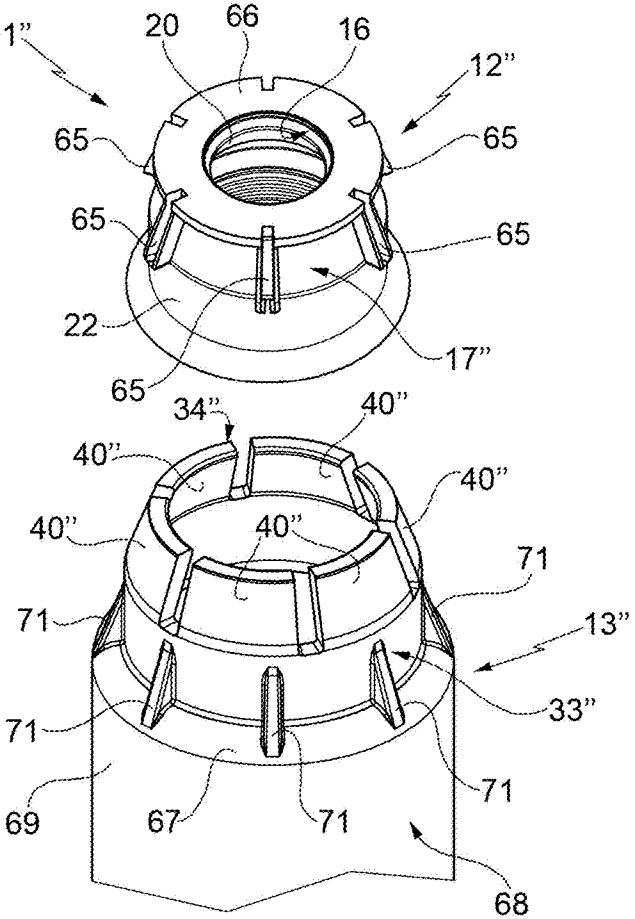
FIG. 14 illustrates the gasket of FIG. 11 in an exploded perspective view, with parts removed for clarity.
Figure 13:
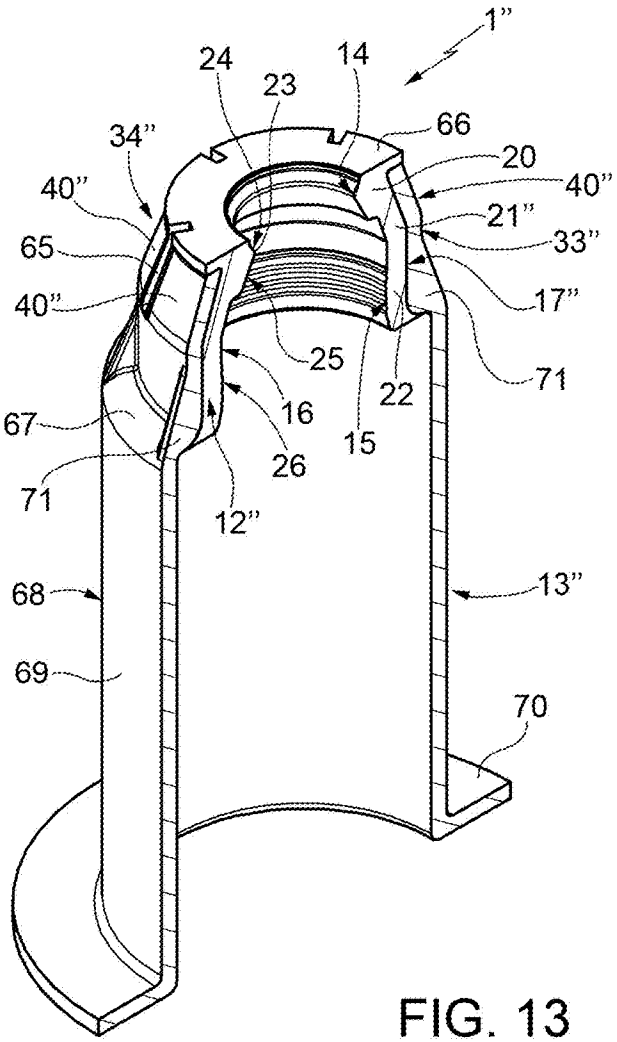
FIG. 13 illustrates the gasket of FIG. 11 in a partially sectional perspective view.
Figure 16:
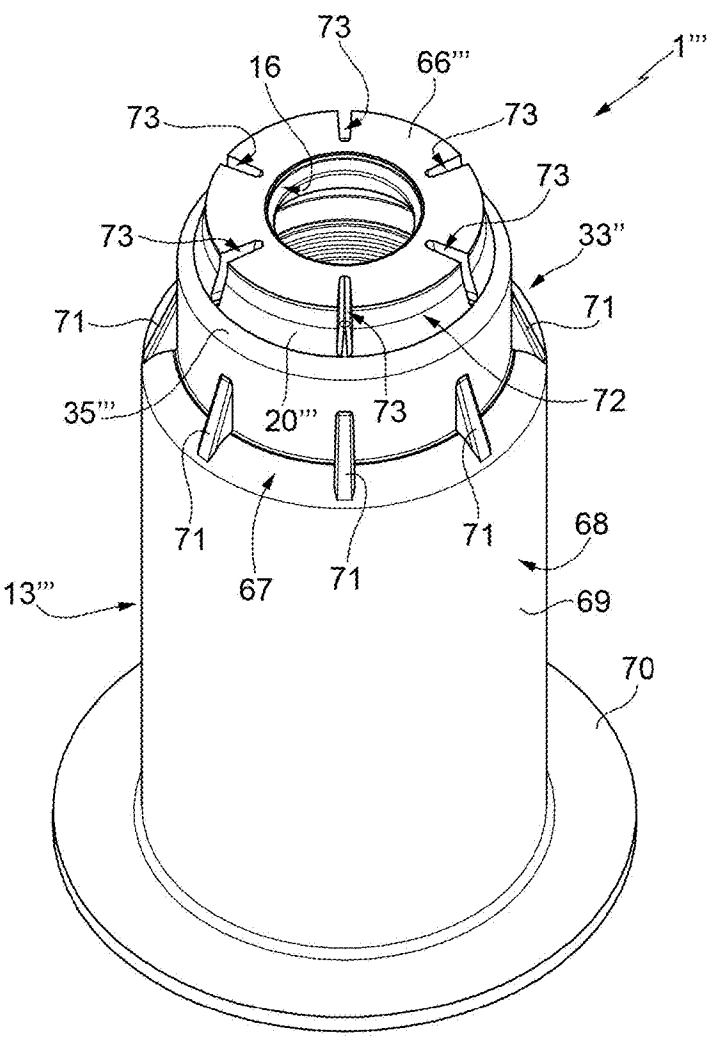
FIG. 16 illustrates the gasket of FIG. 15 in a perspective view.
Figure 15:
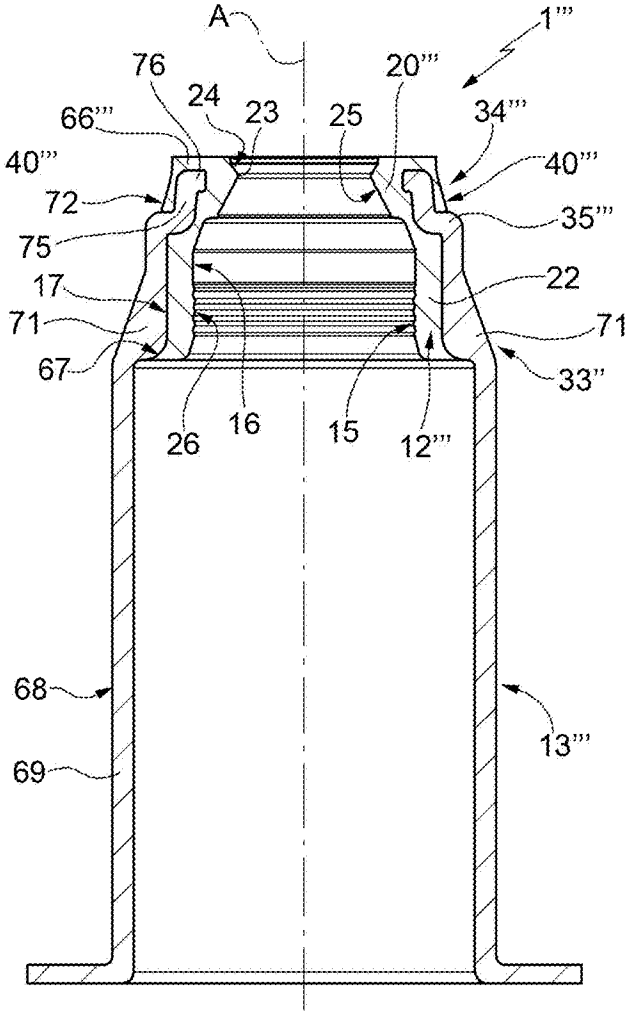
FIG. 15 illustrates in an axial section a further example of embodiment of a gasket according to the present invention.
Figure 18:
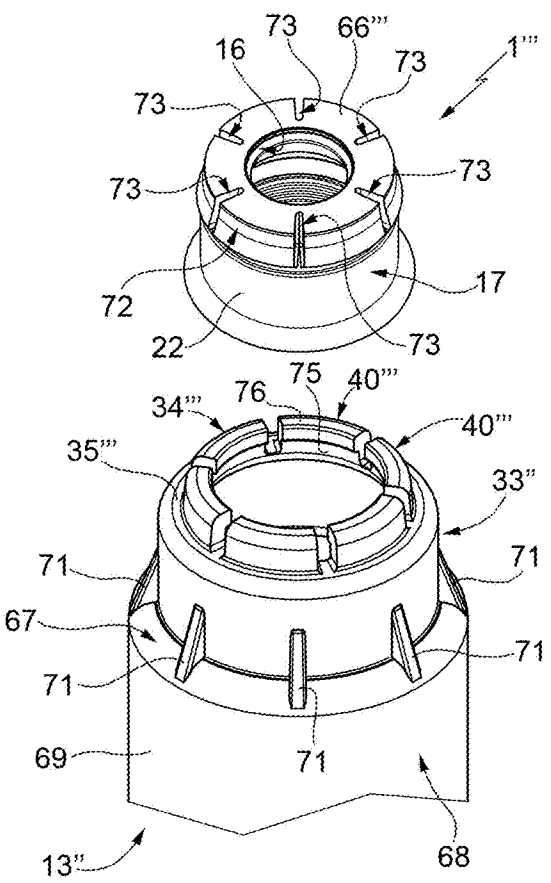
FIG. 18 illustrates the gasket of FIG. 15 in an exploded perspective view, with parts removed for clarity.
Figure 17:
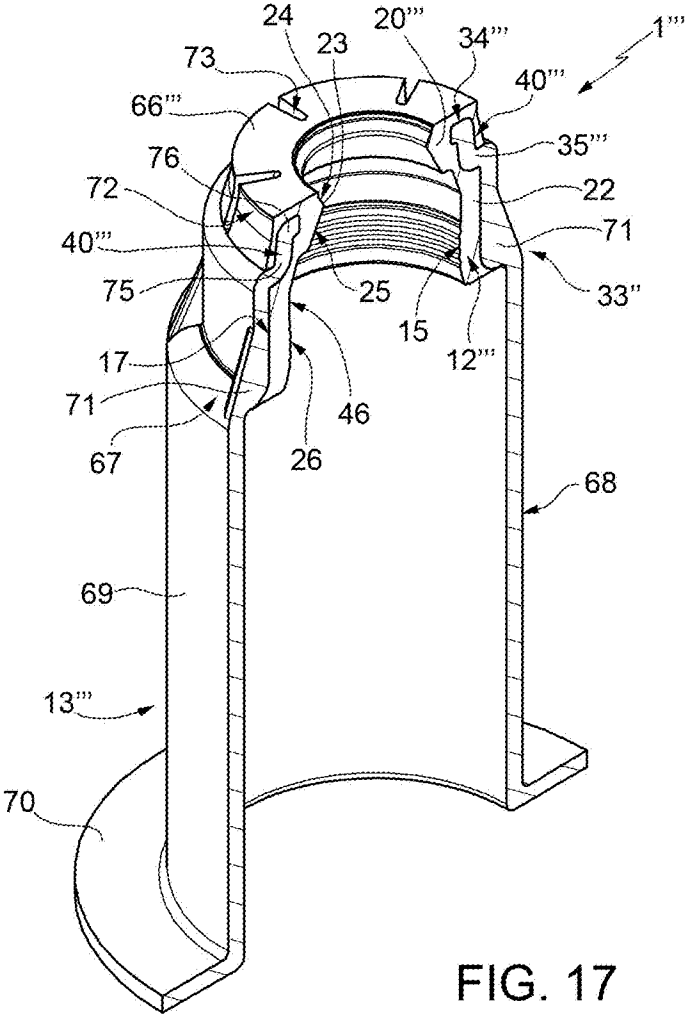
FIG. 17 illustrates the gasket of FIG. 15 in a partially sectional perspective view.
Figure 20:
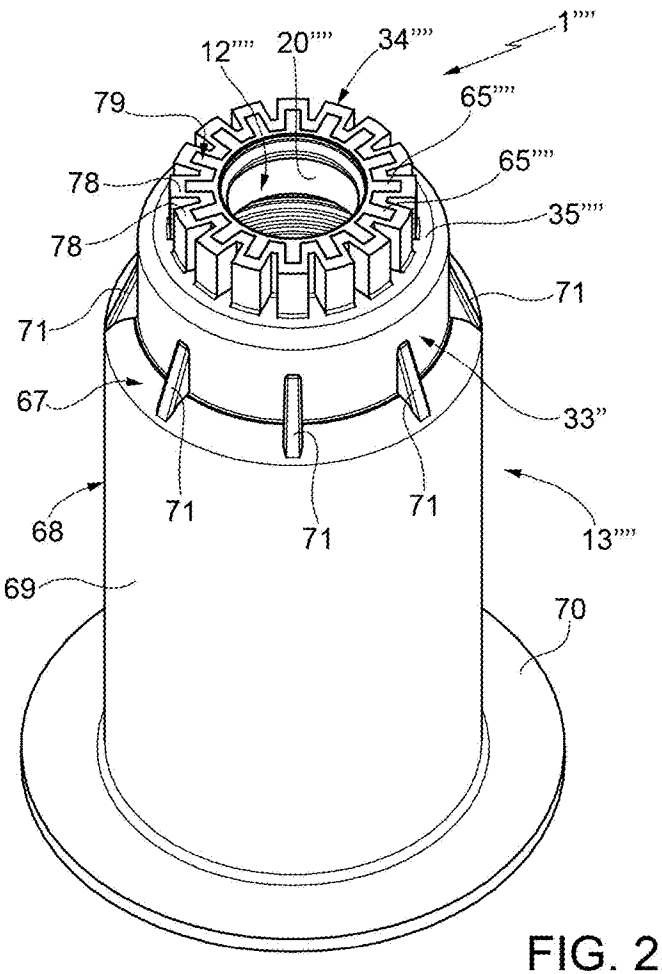
FIG. 20 illustrates the gasket of FIG. 19 in a perspective view.
Figure 19:
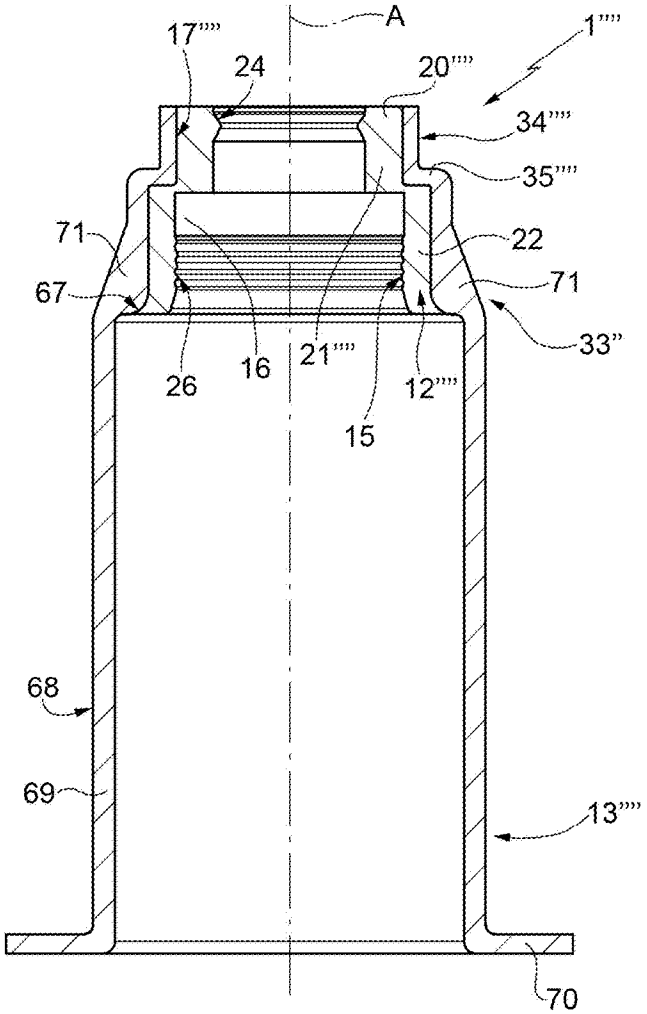
FIG. 19 illustrates in an axial section a further example of embodiment of a gasket according to the present invention.
Figure 22:
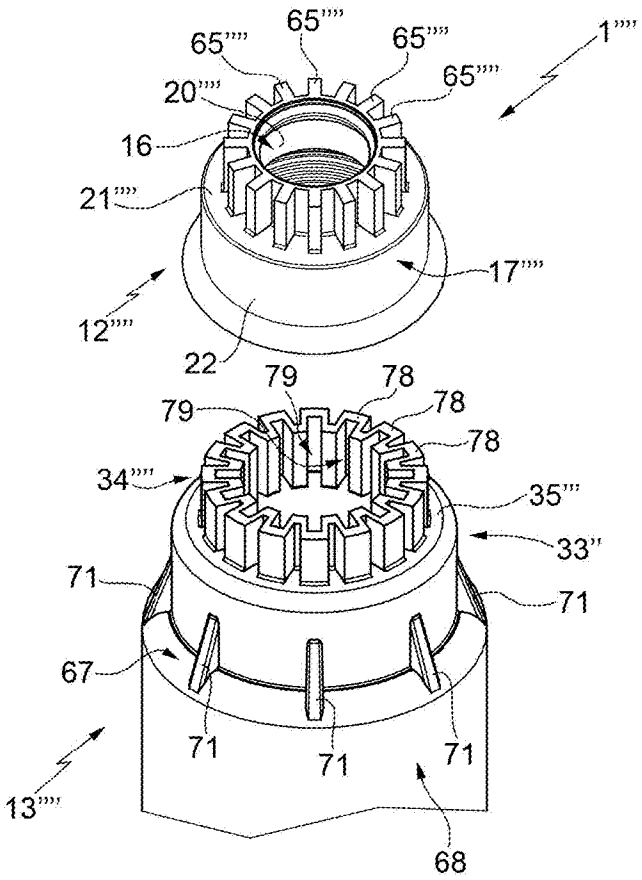
FIG. 22 illustrates the gasket of FIG. 19 in an exploded perspective view, with parts removed for clarity.
Figure 21:
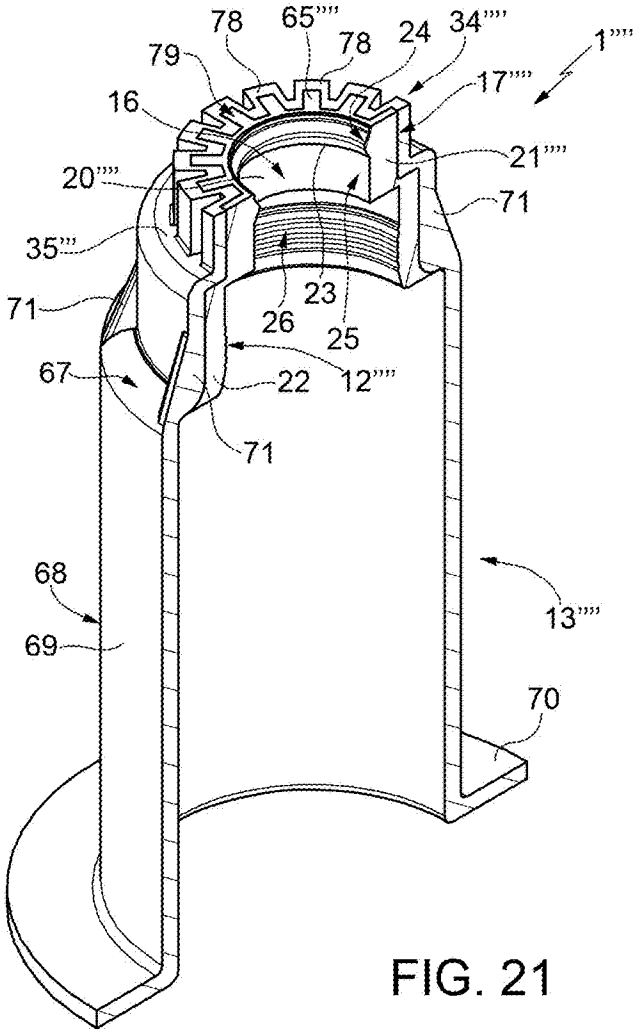
FIG. 21 illustrates the gasket of FIG. 19 in a partially sectional perspective view.

Advantageously, the seal element 12 is made by injection moulding in a moulding chamber 45 (FIG. 6) containing the support member 13 so as to achieve, at the end of the moulding operation, a physical union between the seal element 12 and the support member 13.

In particular, the aforesaid union is achieved by means of a silane resin, preferably spread on the surfaces of the support member 13 intended to be joined, at the end of the injection moulding operation, with the seal element 12.

In detail, the moulding chamber 45 is made inside a mould 46 formed by three distinct pieces:

- a fixed central die 47 having an axial symmetrical main portion 48, the radially external surface 49 of which is adapted to define the negative of the shape of the side surface 16 of the seal element 12, and a base flange 50 projecting radially with respect to the main portion 48;
- a first annular punch 51 fitted in use with radial clearance on the main portion 48 of the die 47 until it is arranged resting on the base flange 50 and having a radially internal surface 52 adapted to contact the retention portion 33 of the support member 13; and
- a second annular punch 53 fitted in use with radial clearance on the main portion 48 of the die 47 until it is arranged resting on the annular punch 51 and having a radially internal surface 54 adapted to define the negative of the shape of the side surface 17 of the portion 20 of the seal element 12.

A channel 55 is formed between the annular punch 53 and the end portion of the die 47 opposite the base flange 50 for injection of the molten elastomeric material.

The radially external surface 49 of the die 47 and the radially internal surfaces 52, 54 of the annular punches 51, 53 delimit the moulding chamber 45.

At the end of the moulding operation, the elastomeric material solidifies and creates a chemical-physical bond with the support member 13.

The gasket 1 is extracted from the mould 46 as follows;

- firstly, the annular punch 53 is axially separated from the die 47;
- subsequently, also the annular punch 51 is extracted axially from the die 47 taking the gasket 1 with it; and
- finally, the part of the injection initially created in the channel 55 between the die 47 and the annular punch 53 is cut from the gasket 1.

With reference to FIGS. 7 to 10, the reference 1' indicated as a whole a gasket according to a different embodiment of the present invention. The gasket 1' is similar to the gasket 1 and the only part that differs from this latter will be described below; corresponding or equivalent parts of the gaskets 1 and 1' will be identified, where possible, by the same reference numerals.

In particular, the gasket 1' differs from the gasket 1 essentially in that it comprises a support member 13' having:

- a retention portion 33' having a shape with a diameter progressively increasing starting from the connection portion 35; and
- an annular end flange 60 projecting radially outwards with respect to the retention portion 33', extending to an axial end of the retention portion 33' opposite the end from which the connection portion 35 originates and intended to cooperate in use with the spring 11 to be pressed by this latter against the fixed surface 4*a* of the portion 4 of the head 5.

In greater detail, the retention portion 33' comprises, proceeding in a direction parallel to the axis A from the connection portion 35 towards the flange 60:

- a first axial or cylindrical segment 61 originating from the connection portion 35;
- an oblique or conical segment 62, having a diameter increasing towards the flange 60; and
- a second axial or cylindrical segment 63, connecting the segment 62 to the flange 60 and having a larger diameter with respect to that of the segment 61.

Also in this case the support member 13' is formed by a single component made entirely of plastic material, preferably of the same thermoplastic material used for the support member 13. The gasket 1' comprises a seal element 12', which is formed by injection moulding in the same way indicated for the seal element 12 except for the shape of the surfaces that delimit the moulding chamber 45; in fact, in this case, the seal element 12' comprises a side surface 17' complementary to the inner annular surface of the retention portion 33' to which it adheres at the end of the moulding operation.

With reference to FIGS. 11 to 14 the reference numeral 1" indicates as a whole a gasket according to a different embodiment of the present invention. The gasket 1" is similar to the gasket 1 and only the parts that differ from this latter will be described below; corresponding or equivalent parts of the gaskets 1 and 1" will be identified, where possible, by the same reference numerals.

In particular, the gasket 1" differs from the gasket 1 in that it comprises a seal element 12" having:

- a truncated cone shaped portion 21" rather than with an annular step, connecting respective portions 20 and 22 identical to the similar portions of the seal element 12 to each other;
- a plurality of projections 65 projecting radially in an overhanging manner from the side surface 17" of the portions 20 and 21", equally spaced angularly from one another around the axis A and each having a substantially linear and oblique shape with respect to the axis A; and
- a flat annular top lip 66 arranged axially on the opposite side of the portion 20 with respect to the portion 21" and projecting radially outwards with respect to the portion 20.

Moreover, the gasket 1" differs from the gasket 1 in that it comprises a support member 13" having an essentially cylindrical retention portion 33" and a thrust portion 34", extending directly from an axial end edge of the retention portion 33" and formed by a plurality of fins 40" equally spaced angularly from one another around the axis A and converging towards the axis A starting from the retention portion 33".

In particular, the retention portion 33" defines at an axial end thereof opposite the end from which the fins 40" extend, an annular shoulder 67 projecting radially outwards.

In this case, starting from the shoulder 67, a base portion 68 of the support member 13" originates, not present in the gaskets 1 and 1' and essentially formed by a cylindrical body 69, surrounding in use the valve 2, and by an annular flange projecting radially outwards with respect to the cylindrical body 69, extending at an axial end of the cylindrical body 69 opposite the end from which the retention portion 33" originates and intended to cooperate in use with the spring 11 to be pressed by this latter against the fixed surface 4*a* of the portion 4 of the head 5.

Moreover, the retention portion 33" is provided with a plurality of stiffening fins 71, with an essentially triangular profile, projecting in an overhanging manner from an external surface of the retention portion 33" and from the shoulder 67.

Each fin 40" projects in an overhanging manner from the axial end edge of the retention portion 33" opposite the shoulder 67 and extends towards the axis A so as to generate a thrust action on the portion 20 of the seal element 12" such as to cause this latter to abut against the stem 8 at the annular edge 23.

In particular, each fin 40" has a distance progressively decreasingly with respect to the axis A starting from the retention portion 33".

Also in this case, the support member 13" is formed by a single component made entirely of plastic material, preferably of the same thermoplastic material used for the support members 13 and 13'.

Similarly to the gaskets 1 and 1', the seal element 12" is once again made by injection moulding inserting the support member 13" in a moulding chamber (not illustrated) similar to the moulding chamber 45 and differing therefrom only in the shape of the internal delimiting surfaces that must allow forming of the profiles of the seal element 12".

Advantageously, following the moulding operation, the projections 65 of the seal element 12" are formed and engage the spaces between the fins 40" so as to increase the adhesion between the seal element 12" and the support member 13".

With the exception of the projections 65, the rest of the seal element 12", and with it the portion 20, is radially interposed between the fins 40" and the axis A or, in use, between the fins 40" and the valve 2. In other words, the fins 40" cooperate with the radial external side surface 17" of the portion 20 of the seal element 12", from which the projections 65 originate.

With reference to FIGS. 15 to 18 the reference numeral 1'" indicates as a whole a gasket according to a different embodiment of the present invention. The gasket 1'" is similar to the gasket 1" and only the part that differs from this latter will be described below; corresponding or equivalent parts of the gaskets 1" and 1'" will be identified, where possible, by the same reference numerals.

In particular, the gasket 1'" differs from the gasket 1" in that it comprises a seal element 12'" having:

- a portion 20'" without the projections 65; and
- a flat annular top lip 66'", similar to the corresponding top lip 66 but not projecting radially outwards with respect to the portion 20'".

More precisely, the portion 20'" is delimited by a truncated cone shaped side surface 72 connecting, without steps, the radially external annular end edge of the top lip 66'" to the portion 21".

Moreover, the portion 20'" and the top lip 66'" are provided, on their radially outermost side, with a plurality of radial slots 73, equally spaced angularly from one another around the axis A.

Further, the gasket 1'" differs from the gasket 1" in that it comprises a support member 13'" identical to the support member 13" with regard to the retention portion 33" and the base portion 68 but having a thrust portion 34'", which originates from a connection portion 35'", similar to the connection portion 35 of the gasket 1, and is incorporated within the portions 20'" and 21" of the seal element 12'".

In particular, the connection portion 35'" extends radially to the axis A and partially penetrates the seal element 12'".

The thrust portion 34'" comprises a plurality of fins 40'" extending directly from the radially innermost edge of the connection portion 35'", equally spaced angularly from one another around the axis A and projecting towards the axis A starting from the connection portion 35'" so as to generate a thrust action on the portion 20'" of the seal element 12'" such as to cause this latter to abut against the stem 8 at the annular edge 23.

In greater detail, each fin 40'" has in cross section a profile substantially in the shape of an upside down L and comprises:

- an axial portion 75 extending from the radially innermost edge of the connection portion 35'" and defined by a segment of cylindrical wall with axis A; and
- a radial pressure portion 76, projecting in an overhanging manner from an end of the axial portion 75 opposite the connection portion 35'" and extending from this latter towards the axis A.

Also in this case, the support member 13'" is formed by a single component made entirely of plastic material, preferably in the same thermoplastic material used for the support members 13, 13' and 13".

Similarly to the gaskets 1, 1', 1", the seal element 12'" is once again made by injection moulding inserting the support member 13'" in a moulding chamber (not illustrated) similar to the moulding chamber 45 and differing therefrom only in the shape of the internal delimiting surfaces that must allow forming of the profiles of the seal element 12'''.

Advantageously, following the moulding operation the fins 40''' and part of the connection portion 35''' of the support member 13''' remain incorporated within the seal element 12'''.

With reference to FIGS. 19 to 22, the reference numeral 1'''' indicates as a whole a gasket according to a different embodiment of the present invention. The gasket 1'''' is similar to the gasket 1''' and only the part that differs from this latter will be described below; corresponding or equivalent parts of the gaskets 1''' and 1'''' will be identified, where possible, by the same reference numerals.

In particular, the gasket 1'''' differs from the gasket 1''' in that it comprises a seal element 12'''' without the top lip 66''' and having:

- an annular step portion 21'''' similar to the portion 21 of the gasket 1; and
- a cylindrical portion 20'''' with axis A provided externally with a plurality of radial projections 65'''', equally spaced angularly from one another around the axis A and each having a shape substantially linear and parallel to the axis A.

Moreover, the gasket 1'''' differs from the gasket 1''' in that it comprises a support member 13'''' identical to the support member 13''' with regard to the retention portion 33'', the base portion 68 and the connection portion 35''' but having a thrust portion 34'''', which cooperates with an external side surface 17'''' of the portion 20'''' of the seal element 12'''' and has a shape complementary to this latter.

In particular, the thrust portion 34'''' has an annular shape and is configured as a sort of wave, preferably a square wave, i.e. consisting of a plurality of repeated elements 78 (FIGS. 20-22), each having in axial section a concave shape, preferably U-shaped, with cavity 79 facing the axis A and joined sidely to one another at the respective free ends.

The cavity 79 of each element 78 of the thrust portion 34'''' is configured to receive in use a respective projection 65'''' of the portion 20'''' of the seal element 12''''.

Also in this case, the support member 13'''' is formed by a single component made entirely of plastic material, preferably of the same thermoplastic material used for the support members 13, 13', 13'' and 13'''.

Similarly to the gaskets 1, 1', 1'', 1''', the seal element 12'''' is once again made by injection moulding inserting the support member 13'''' in a moulding chamber (not illustrated) similar to the moulding chamber 45 and differing therefrom only in the shape of the internal delimiting surfaces that must allow forming of the profiles of the seal element 12''''.

Advantageously, following the moulding operation, the projections 65'''' of the portion 20'''' of the seal element 12'''' engage the respective cavities 79 of the elements 78 of the support member 13'''', adhering to this latter with a chemical-physical bond.

By examining the features of the gaskets 1, 1', 1'', 1''', 1'''' made according to the dictates of the present invention, the advantages that can be achieved are evident.

In particular, due to the fact that, for each gasket 1, 1', 1'', 1''', 1'''', the relative seal element 12, 12', 12'', 12''', 12'''' is always made through injection moulding in a moulding chamber in which the corresponding support member 13, 13', 13'', 13''', 13'''' is positioned, it is possible to avoid:

- having to manage the seal element 12, 12', 12'', 12''', 12'''' during the production process; and
- having to perform mechanical coupling between the components of the gasket 1, 1', 1'', 1''', 1''''.

Moreover, the union between the seal element 12, 1', 12'', 12''' and 12'''' and the respective support member 13, 13', 13'', 13''', 13'''' is sturdier and more reliable, and less sensitive to tolerances with respect to gaskets of known type.

Finally, it is clear that modifications and variants can be made to the gaskets 1, 1', 1'', 1''', 1'''' described and illustrated herein, without departing from the scope of protection defined by the claims.

The invention claimed is:

1. A gasket for a valve of an internal combustion engine, said valve comprising a guide element defining a through seat and a stem sliding in said seat, said gasket comprising:

- an elastically deformable seal element having an annular shape with respect to an axis and adapted to be arranged externally on said valve to cooperate with said stem and/or with said guide element;
- a support member made of plastic having an annular shape with respect to said axis and having at least one retention portion coupled coaxially on a first portion of said seal element so that said first portion is in use radially interposed between said retention portion of said support member and said guide element of said valve; and
- an elastic member acting on a second portion of said seal element, distinct from said first portion, to radially press in use the second portion on said stem of said valve;
- wherein said elastic member comprises a thrust portion of said support member made in one single piece with said retention portion;
- wherein said seal element is formed by means of an injection moulding operation in a moulding chamber containing said support member;
- wherein said seal element and said support member are physically joined to one another at the end of the moulding operation; and
- wherein the seal element and the support member are joined by a silane resin.

2. A gasket according to claim 1, wherein said elastic member is defined by said thrust portion of said support member.

3. A gasket according to claim 1, wherein said retention portion and said thrust portion of said support member are arranged in sequence one after the other along said axis.

4. A gasket according to claim 1, wherein said thrust portion of said support member comprises a plurality of fins equally spaced angularly from one another around said axis and each having at least one pressure portion which projects towards the axis to generate a thrust action on said second portion of said seal element.

5. A gasket according to claim 4, wherein said fins are entirely incorporated within said second portion of said seal element.

6. A gasket according to claim 4, wherein said pressure portion of each said fin has a distance progressively decreasing with respect to said axis starting from an area adjacent to said retention portion as far as an edge with minimum radial distance from the axis, and wherein each said fin further comprises a further portion having a distance progressively increasing with respect to said axis starting from said edge.

7. A gasket according to claim 4, wherein said pressure portion of each said fin extends radially with respect to said axis starting from a further portion, preferably axial, interposed between the pressure portion and said retention portion.

8. A gasket according to claim 4, wherein said fins cooperate with a radially external lateral surface of said seal element, and wherein said second portion of said seal element has a plurality of projections projecting outwards in an overhanging manner from said radially external lateral surface of the seal element, equally spaced angularly from one another around said axis and engaging, following said moulding operation, respective spaces between said fins.

9. A gasket according to claim 1, wherein said thrust portion of said support member has an annular shape and is configured as a wave consisting of a plurality of repeated elements, each defining a relative cavity facing said axis and joined laterally to one another, and wherein said second portion of said seal element is provided externally with a plurality of projections equally spaced angularly from one another around said axis and engaging respective said cavities of said repeated elements.

10. A gasket according to claim 9, wherein said second portion of said seal element is configured as a square wave, and wherein said repeated elements have in axial section a U-shaped conformation.

11. A gasket according to claim 1 wherein the seal element comprises a fluorinated elastomer.

12. A gasket according to claim 1 wherein the support member comprises a polyamide polymer.

13. A gasket for a valve of an internal combustion engine, said valve comprising a guide element defining a through seat and a stem sliding in said seat, said gasket comprising:

an elastically deformable seal element having an annular shape with respect to an axis and adapted to be arranged externally on said valve to cooperate with said stem and/or with said guide element;

a support member made of plastic having an annular shape with respect to said axis and having at least one retention portion coupled coaxially on a first portion of said seal element so that said first portion is in use radially interposed between said retention portion of said support member and said guide element of said valve; and an elastic member acting on a second portion of said seal element, distinct from said first portion, to radially press in use the second portion on said stem of said valve;

wherein said elastic member comprises a thrust portion of said support member made in one single piece with said retention portion;

wherein said seal element is formed by means of an injection moulding operation in a moulding chamber containing said support member;

wherein said seal element and said support member are physically joined to one another at the end of the moulding operation;

wherein said thrust portion of said support member comprises a plurality of fins equally spaced angularly from one another around said axis and each having at least one pressure portion which projects towards the axis to generate a thrust action on said second portion of said seal element; and wherein said fins cooperate with a radially external lateral surface of said seal element, and wherein said second portion of said seal element has a plurality of projections projecting outwards in an overhanging manner from said radially external lateral surface of the seal element, equally spaced angularly from one another around said axis and engaging, following said moulding operation, respective spaces between said fins.

14. A gasket for a valve of an internal combustion engine, said valve comprising a guide element defining a through seat and a stem sliding in said seat, said gasket comprising:

an elastically deformable seal element having an annular shape with respect to an axis and adapted to be arranged externally on said valve to cooperate with said stem and/or with said guide element;

a support member made of plastic having an annular shape with respect to said axis and having at least one retention portion coupled coaxially on a first portion of said seal element so that said first portion is in use radially interposed between said retention portion of said support member and said guide element of said valve; and an elastic member acting on a second portion of said seal element, distinct from said first portion, to radially press in use the second portion on said stem of said valve;

wherein said elastic member comprises a thrust portion of said support member made in one single piece with said retention portion;

wherein said seal element is formed by means of an injection moulding operation in a moulding chamber containing said support member;

wherein said seal element and said support member are physically joined to one another at the end of the moulding operation;

wherein said thrust portion of said support member has an annular shape and is configured as a wave consisting of a plurality of repeated elements, each defining a relative cavity facing said axis and joined laterally to one another, and wherein said second portion of said seal element is provided externally with a plurality of projections equally spaced angularly from one another around said axis and engaging respective said cavities of said repeated elements.

* * * * *